United States Patent [19]

Wey et al.

[11] Patent Number: 4,552,838

[45] Date of Patent: Nov. 12, 1985

[54] PROCESSES FOR THE PREPARATION OF SILVER HALIDE EMULSIONS OF CONTROLLED GRAIN SIZE DISTRIBUTION, EMULSIONS PRODUCED THEREBY, AND PHOTOGRAPHIC ELEMENTS

[75] Inventors: Jong-Shinn Wey, Penfield; Thomas E. Whiteley, Rochester; James M. Hamlin, Brockport, all of N.Y.

[73] Assignee: Eastman Kodak Company, Rochester, N.Y.

[21] Appl. No.: 611,774

[22] Filed: May 18, 1984

[51] Int. Cl.[4] ..... G03C 1/02; G03C 1/00

[52] U.S. Cl. ..... 430/569; 430/567; 430/568; 430/596

[58] Field of Search ..... 430/567, 568, 569, 596

[56] References Cited

U.S. PATENT DOCUMENTS

| | | | |
|---|---|---|---|
| 3,367,778 | 2/1968 | Berriman et al. | 430/411 |
| 3,415,650 | 12/1968 | Frame et al. | 430/642 |
| 3,482,982 | 12/1969 | Miyata et al. | 430/569 |
| 3,650,757 | 3/1972 | Irie et al. | 430/567 |
| 3,761,276 | 9/1973 | Evans | 430/217 |
| 3,790,386 | 2/1974 | Posse et al. | 430/642 |
| 3,897,935 | 8/1975 | Forster et al. | 366/339 |
| 4,046,576 | 9/1977 | Terwilliger et al. | 430/569 |
| 4,184,878 | 1/1980 | Maternaghan | 430/567 |
| 4,242,445 | 12/1980 | Saito | 430/567 |
| 4,269,927 | 5/1981 | Atwell | 430/217 |
| 4,334,012 | 6/1982 | Mignot | 430/567 |
| 4,336,328 | 6/1982 | Brown et al. | 430/569 |
| 4,349,622 | 9/1982 | Koitabashi et al. | 430/567 |
| 4,446,228 | 5/1984 | Honda et al. | 430/567 |
| 4,481,288 | 11/1984 | Yamada et al. | 430/567 |

FOREIGN PATENT DOCUMENTS

| | | |
|---|---|---|
| 41-65799 | 10/1966 | Japan . |
| 1170648 | 11/1969 | United Kingdom . |

*Primary Examiner*—Mary F. Downey

*Attorney, Agent, or Firm*—Carl O. Thomas

[57] ABSTRACT

A process is disclosed of producing photographically useful radiation sensitive silver halide emulsions the grains of which are of a predetermined size distribution, including selection of maximum and minimum grain diameters and selection of the distribution of grains of maximum, minimum, and intervening diameters. This is achieved by modifying a double jet precipitation to introduce during the run stable silver halide grains capable of acting as host grains for the deposition of additional silver and halide ions. The degree to which the host grains initially introduced are grown determines the maximum grain diameter of the emulsion. The minimum diameter of the grains in the emulsion produced can be determined by the diameter of the stable silver halide grains introduced at the end of the run. The rate at which the stable host grains are introduced during the run controls the distribution of intervening grain sizes.

The silver halide emulsion produced in various forms can be comprised of silver halide grains differing in diameter such that (a) the relative frequency of grain size occurrences is relatively invariant over much of the range of grain sizes present; (b) the maximum relative frequency of grain sizes occurs near the minimum grain diameter of the emulsion; (c) the maximum relative frequency of grain sizes occurs near the maximum grain diameter; or (d) maximum relative frequencies of grain sizes occur near both the maximum and minimum grain sizes.

35 Claims, 16 Drawing Figures

PROCESSES FOR THE PREPARATION OF SILVER HALIDE EMULSIONS OF CONTROLLED GRAIN SIZE DISTRIBUTION, EMULSIONS PRODUCED THEREBY, AND PHOTOGRAPHIC ELEMENTS

FIELD OF THE INVENTION

This invention relates to processes for the preparation of radiation sensitive silver halide emulsions, to silver halide emulsions produced by these processes, and to photographic elements incorporating these silver halide emulsions.

BACKGROUND OF THE INVENTION

The distribution of silver halide grain sizes within a radiation sensitive silver halide emulsion is recognized as a fundamental determinant of its properties. This can be illustrated by reference to FIG. 1 wherein a characteristic curve described by James and Higgins, *Fundamentals of Photographic Theory,* Wiley, 1948, p. 180, is shown. Within the segment BC of the characteristic curve density increases linearly with tne logarithm of exposure. The exposure range MN constitutes the exposure latitude of the emulsion. As exposure is decreased below level M reductions in density become progressively less until point A on the characteristic curve is reached below which no further decrease in density is observed. Thus, the density at point A corresponds to the minimum density, $D_{min}$, of the emulsion. The segment AB is referred to as the toe of the characteristic curve. If exposure is increased beyond N, increases in density become progessively less until a point D is reached beyond which no further increase in density is observed. Thus, the density at point D corresponds to the maximum density, $D_{max}$, of the emulsion. The segment CD is referred to as the shoulder of the characteristic curve. The tangent of the angle $\alpha$, referred to as $\gamma$, is a way of describing the slope of the characteristic curve.

If all of the silver halide grains present in the emulsion were exactly the same size and identically sensitized, the segment BC of the characteristic curve would approach the vertical—i.e., $\gamma$ would be extremely high. Exposure latitude MN would be extremely narrow. Broader exposure latitude is observed in actual emulsions largely because a distribution of silver halide grain sizes are present in silver halide emulsions. The density increase in the toe and adjacent portion of tne characteristic curve results from the disproportionate response of larger silver halide grains to lower levels of exposure while the density increase in the shoulder and adjacent portion of the curve is the result of the smaller silver halide grains reaching their latent image forming threshold on exposure.

An idealized response for a silver halide emulsion would be a characteristic curve that is linear in both its toe and shoulder, as indicated by A'B and CD', thereby extending its exposure latitude. One explanation for the density of A lying above A'—i.e., elevated minimum density levels—is that the tendency toward spontaneous development of silver halide grains increases as the size of the grains increases. Similarly, an explanation for the density disparity between D and D' is the presence of grains too small to contribute usefully to photographic imaging.

From the foregoing it is apparent that a controlled distribution of silver halide grains is desirable to select exposure latitude. At the same time it is apparent that both the very largest and the very smallest grains present in an actual silver halide emulsion contribute only marginally to imaging. While FIG. 1 depicts the characteristic curve of a negative working silver halide emulsion, essentially similar relationships can be identified and conclusions drawn from the characteristic curve of a direct positive silver halide emulsion.

Although fundamentally important to controlling imaging, the distributions of silver halide grain sizes in the emulsions of photographic elements have represented accommodations to manufacturing capabilities rather than grain size distributions that would have been chosen given an unrestrained freedom of choice. The art has long employed for differing photographic applications silver halide emulsions ranging in mean diameter over approximately three orders of magnitude—e.g., 0.03 $\mu$m for high resolution film to about 2.5 $\mu$m for medical X-ray film. Recently developed high aspect ratio tabular grain emulsions have extended useful grain diameters upwardly by at least another order of magnitude. For some applications, such as lithographic films, high gammas (typically greater than 10) and high image discrimination (Dmax−Dmin) are required while for other applications, such as camera films and medical X-ray films, much lower gammas (typically 1.5) and extended exposure latitudes (2 log E or greater) are sought. However, in each of these emulsions the silver halide grain distribution is constituted by a peak frequency of grains at or near the mean diameter with numerous additional grains being present departing from the peak frequency size by an error distribution, typically a Gaussian (i.e., normal) distribution.

Characteristically the formation of a silver halide grain population in manufacturing a photographic emulsion is the result of silver halide precipitation, wherein silver and halide ions react to form silver halide, and physical ripening, wherein the grains attain approximately their final size and form. While ripening can and does occur to some extent concurrently with precipitation, it is in general a slower step that requires holding the emulsion for a period of time following the termination of precipitation.

Single jet precipitation procedures are recognized to produce silver halide grains of an extended range of sizes. FIG. 2 is an illustration of a neutral octahedral silver bromoiodide emulsion and FIG. 3 is an illustration of an ammoniacal cubic bromoiodide emulsion, each prepared by single jet precipitation. These illustrative emulsions are described by Duffin, *Photographic Emulsion Chemistry,* Focal Press, 1966, pp. 66 through 74. Single jet precipitation runs silver salt into a reaction vessel containing the halide salt. While this produces a wide distribution of grain sizes, it also inherently results in the excess of halide ions continuously varying throughout the run with attendant non-uniformity in grain crystal structures.

To obtain better control over the silver halide precipitation reaction silver halide emulsions have been increasingly prepared by double jet precipitation techniques. By this technique silver and halide ions are concurrently introduced into a reaction vessel containing a dispersing medium and, usually, a small portion of halide salt used to provide a halide ion excess. Double jet precipitation has the advantage of allowing silver and halide ion concentrations, usually expressed as the negative logarithm of silver or halide ion activity (e.g., pAg or pBr) to be controlled, thereby also controlling the grain crystal structure.

A second important characteristic of double jet precipitation is that it can produce a narrower size distribution of silver halide grains than single jet precipitation. This is an advantage when higher gamma emulsions are sought, but a disadvantage when extended exposure latitudes are desired. Double jet precipitation, though allowing compression of the range of grain sizes present, also produces a normal or Gaussian error distribution of grain sizes.

Silver halide emulsions of narrower and broader grain size distributions are often distinguished by being characterized as "monodisperse" and "polydisperse" emulsions, respectively. Emulsions having a coefficient of variation of less than 20% are herein regarded as monodisperse. Emulsions intended for applications requiring extremely high $\gamma$ often require coefficients of variation below 10%. As employed herein the coefficient of variation is defined as 100 times the standard deviation of the grain diameters divided by the mean grain diameter. From this definition it is apparent that as between emulsions of identical coefficients of variation those having lower mean grain diameters exhibit a lower range of grain sizes present. For this reason the error distribution of grain sizes in monodisperse fine grain emulsions—that is, those less than about 0.2 $\mu$m in mean grain diameter—is typically regarded for practical purposes as negligible. However, as mean grain diameter increases not only does absolute divergence in grain sizes increase at a given coefficient of variation, but also it becomes increasingly difficult to obtain low coefficients of variation. It is, for example, relatively more difficult to achieve low coefficients of variation in preparing high aspect ratio tabular grain emulsions.

Although double jet precipitation is normally practiced as a batch process, it is possible to withdraw product emulsion continuously while concurrently introducing reactants, thereby transforming the process into a continuous one. In this latter instance the size-frequency distribution curve becomes asymmetrically distorted, as shown by the illustrative curve in FIG. 4. (Plotting diameter on a logarithmic scale can be undertaken to obtain a more symmetrical curve.) However, like the product emulsion of each of the preceding precipitation processes, the size-frequency distribution curve of the product emulsion exhibits an error distribution of grain sizes that is dictated by the precipitation process employed.

Because of the limitations of silver halide grain formation processes, post formation adjustments are commonly employed to improve product emulsion grain size distributions and thereby achieve aim characteristic curves. For example, increasing the proportion of relatively larger or smaller silver halide grains in an emulsion fraction can be achieved by hydrocyclone separation techniques. More commonly, particularly in extending exposure latitude, separately prepared and sensitized emulsions are blended (or coated in separate layers) to obtain an aim characteristic curve. Trial and error sensitization and blending or coating are required to achieve the aim characteristic curve shape. Post formation adjustments of silver halide grain distributions add significantly to the complexity of preparing useful radiation sensitive emulsions and photographic elements. Even so, process of precipitation imposed limitations on silver halide grain size distributions are merely modified, not eliminated, by post formation adjustments.

Considering the fundamental importance of silver halide grain size distribution and the limited success achieved in the art in modifying grain size distributions, it is not surprising that a plethora of variant silver halide precipitation schemes have been advanced over the years. The following, primarily directed to variants of double jet precipitation techniques, are considered illustrative of the prior state of the art:

P-1 Frame et al U.S. Pat. No. 3,415,650 discloses a basic double jet precipitation apparatus with an efficient stirring device.

P-2 Miyata U.S. Pat. No. 3,482,982 discloses the addition of iodide ions either in crystalline or soluble salt form during single jet precipitation of silver bromoiodide.

P-3 Irie et al U.S. Pat. No. 3,650,757 discloses the double jet precipitation of monodisperse silver halide emulsions with accelerated rates of silver and halide salt introductions.

P-4 Posse et al U.S. Pat. No. 3,790,386 and Forster et al U.S. Pat. No. 3,897,935 disclose the double jet precipitation of silver halide emulsions while circulating between grain nucleation and growth zones.

P-5 Terwilliger et al U.S. Pat. No. 4,046,576 discloses a continuous double jet precipitation process.

P-6 Maternaghan U.S. Pat. No. 4,184,878 discloses employing preformed high iodide silver halide grains in preparing tabular grain emulsions.

P-7 Saito U.S. Pat. No. 4,242,445 discloses increasing the concentrations of soluble silver, halide, or silver and halide salts during double jet precipitation of monodisperse silver halide emulsions.

P-8 Mignot U.S. Pat. No. 4,334,012 and Brown et al U.S. Pat. No. 4,336,328 disclose performing ultrafiltration during the course of double jet precipitation, either in a unitary reaction vessel arrangement or in an arrangement employing grain nucleation and growth zones.

P-9 Japanese application No. 65799/66, filed Oct. 6, 1966, discloses preparing a highly sensitive, high $\gamma$ emulsion by adding a silver chloride emulsion as well as silver and halide salts to prepare a negative working emulsion.

P-10 U.K. Pat. No. 1,170,648 discloses preparing a silver halide emulsion by placing silver halide seed grains in the reaction vessel before running in silver and halide salts.

The preparation of silver halide emulsions intended to trap photogenerated electrons within the interior of the grains, most frequently employed for direct positive imaging, is generally recognized to be more complex than preparing negative working silver halide emulsions in which the photogenerated electrons form surface latent images predominantly on the surfaces of the grains. This is particularly true when moderate or longer exposure latitudes are required. Commonly employed direct positive emulsions which rely on internal trapping of electrons are those (a) in which the surfaces of the grains are fogged and photogenerated holes are relied upon to bleach surface fog and (b) in which internally trapped electrons form a desensitizing internal latent image that retards surface development. The higher speed direct positive emulsions are of the latter type and rely on silver halide grains which are surface sensitized, but in a controlled manner that preserves the internal latent image forming characteristic of the grains. This is often achieved by forming a monodisperse core emulsion which is either doped or surface sensitized, shelling this core emulsion with additional silver halide, and surface sensitizing to a limited extent the final core-shell grains to increase their sensitivity. When an aim characteristic curve requires the preparation and blending of a plurality of direct positive emulsions, particularly core-shell emulsions, it can be readily appreciated that emulsion preparation can become exceedingly laborious. The following are illustrative of the prior state of the art:

P-11 Berriman U.S. Pat. No. 3,367,778 discloses a direct positive core-shell silver halide emulsion the grains of which are surface fogged rather than being surface sensitized.

P-12 Evans U.S. Pat. No. 3,761,276 discloses a direct positive core-shell silver halide emulsion the grains of which are surface sensitized.

P-13 Atwell et al U.S. Pat. No. 4,269.927 discloses a direct positive core-shell silver halide emulsion prepared by blending emulsions of differing core sensitization.

SUMMARY OF THE INVENTION

In one aspect this invention is directed to an improvement in a process for the preparation of a photographic silver halide emulsion comprised of concurrently introducing silver and halide ions into a reaction vessel containing a dispersing medium to produce radiation sensitive silver halide grains.

The process is characterized by producing a predetermined size distribution of the radiation sensitive silver halide grains, including selection of maximum and minimum grain diameters and selection of the distribution of grains of maximum, minimum, and intervening diameters. This is achieved by the steps of (a) introducing into the reaction vessel a silver halide emulsion consisting essentially of a dispersing medium and stable silver halide grains forming an initial population of host grains capable of acting as deposition sites for the silver and halide ions, (b) introducing into the reaction vessel the silver and halide ions without producing additional stable silver halide grains, thereby depositing silver halide onto the host grains in the reaction vessel to increase their diameters, (c) continuing and regulating introduction into the reaction vessel of the silver halide emulsion consisting essentially of the dispersing medium and the stable silver halide grains to provide additional host grains during the course of introducing the silver and halide ions to obtain the predetermined size distribution of the radiation-sensitive silver halide grains in the photographic emulsion, (d) controlling the minimum diameter of the radiation sensitive silver halide grains in the emulsion by controlling the diameter of the silver halide host grains introduced, and (e) terminating silver halide grain growth when deposition onto the initial population of host grains has produced radiation sensitive silver halide grains of the desired maximum diameter.

In another aspect this invention is directed to silver halide emulsions having grain size distributions which are predetermined and controlled. More specifically, this invention is directed to silver halide emulsions having grain size distributions never before achieved in the art.

In one specific form this invention is directed to a silver halide emulsion comprised of a dispersing medium and silver halide grains differing in diameter wherein the relative frequency of grain size occurrences over the 90 percent mid-range of grain diameters present differs by less than 20 percent.

In another aspect this invention is directed to a silver halide emulsion comprised of a dispersing medium and silver halide grains differing in diameter wherein the maximum relative frequency of grain sizes occurs within the range of grain sizes extending from the minimum grain diameter of the emulsion to grain diameters 20 percent larger than the minimum grain diameter.

In still another aspect this invention is directed to a silver halide emulsion comprised of a dispersing medium and silver halide grains differing in diameter wherein the maximum relative frequency of grain sizes occurs within the range of grain sizes extending from the maximum grain diameter of the emulsion to grain diameters 5 percent less than the maximum grain diameter.

In an additional aspect this invention is directed to an emulsion comprised of a dispersing medium and radiation sensitive core-shell silver halide grains, wherein the core-shell grains differ in diameter, but the core portions of the grains are substantially similar in diameter.

From the foregoing it is apparent that, as a result of this invention, for the first time silver halide emulsions can be obtained with the distribution of grain sizes, including maximum and minimum grain diameters and the distribution of intermediate grain diameters, predetermined independently of the grain size distribution limitations imposed by conventional silver halide grain formation processes. The invention can therefore be employed to eliminate or simplify post formation adjustments of grain size distributions. In specific applications the invention reduces the complexity of preparing silver halide emulsions of moderate and extended exposure latitudes, and the invention simplifies the preparation of core-shell silver halide emulsions to achieve aim characteristic curves.

SUMMARY OF THE DRAWINGS

This invention can be better appreciated by reference to the following detailed description of preferred embodiments considered in conjunction with the drawings, in which.

DESCRIPTION OF PREFERRED EMBODIMENTS

Figure 1:
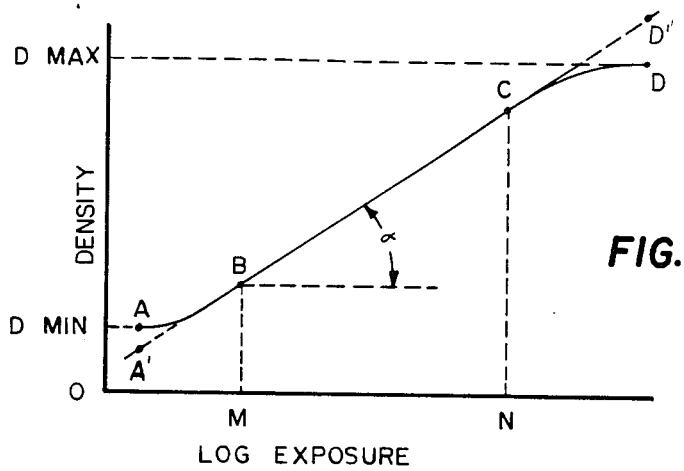
FIG. 1 is a didactic characteristic curve for a negative working silver halide emulsion.
Figure 2:
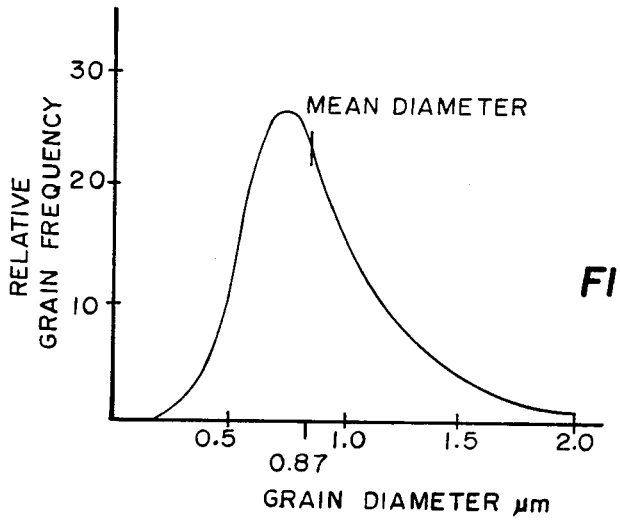
FIGS. 2 and 3 are plots of relative grain frequency versus grain diameter for two conventional silver halide emulsons prepared by single jet precipitation.
Figure 3:
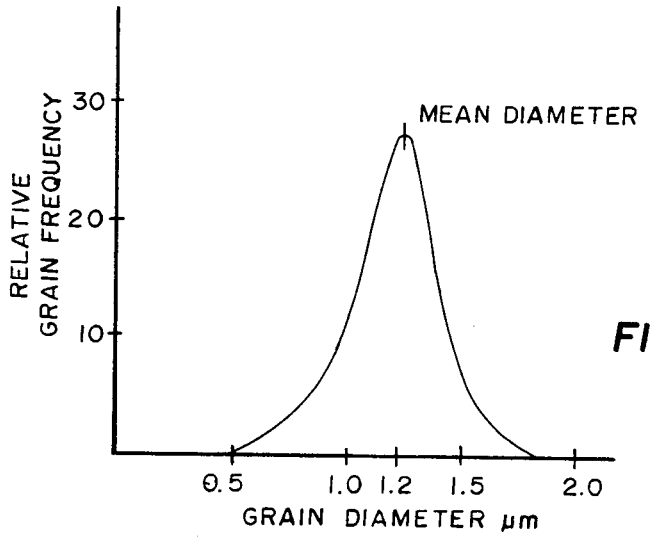
Figure 4:
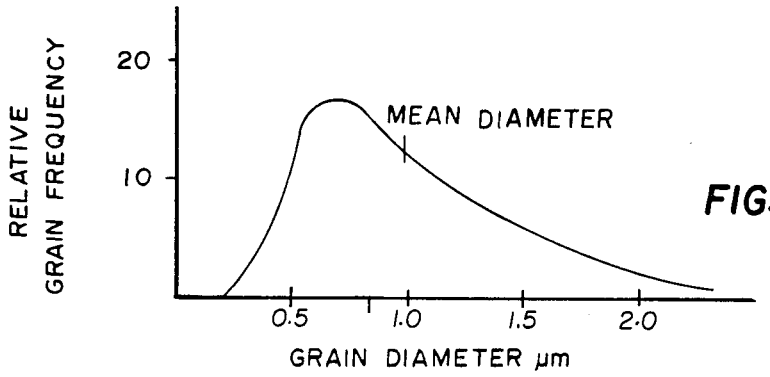
FIG. 4 is a plot of relative grain frequency versus grain diameter for a conventional silver halide emulsion prepared by continuous double jet precipitation.
Figure 5:
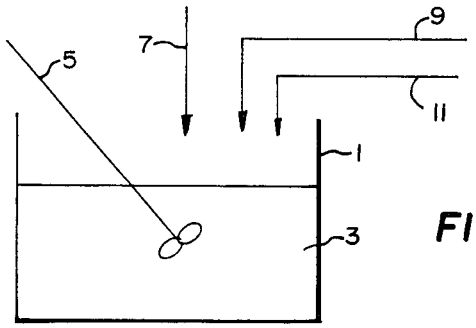
FIG. 5 is a schematic diagram of a batch double jet silver halide emulsion precipitation arrangement useful for the practice of this invention.

The practice of this invention can be appreciated by reference to FIG. 5, wherein a reaction vessel 1 initially contains a dispersing medium 3. A mechanism 5 for stirring the dispersing medium is schematically illustrated as a propellor attached to a rotatable shaft. With the stirring mechanism in operation, a physically ripened silver halide emulsion consisting essentially of a dispersing medium and stable silver halide grains is run into the reaction vessel through jet 7. The stable silver halide grains run into the reaction vessel form an initial grain population and, along with subsequently introduced stable silver halide grains, act as host grains for silver and halide ions run into the reaction vessel separately through jets 9 and 11, respectively. The silver and halide ions introduced separately into the reaction vessel precipitate onto the host silver halide grains already present rather than forming additional silver halide grains. Thus, the silver and halide ions introduced separately produce grain growth rather than renucleation.

For a period of time jets 7, 9, and 11 continue to supply the physically ripened emulsion containing stable silver halide host grains, silver ions, and halide ions, respectively, to the reaction vessel. As silver halide deposition onto the host grains continues, these grains are increased in diameter. The longer the period of time over which a particular host grain is present in the reaction vessels the greater its diameter. Thus, the grains of maximum diameter in the reaction vessel are those that formed the initial grain population introduced.

When the initial host grain population introduced has reached a diameter corresponding to the maximum grain diameter desired in the product emulsion being prepared, introduction of additional silver and halide ions is terminated. Thus, the maximum diameter of the silver halide grains present in the emulsion prepared is within the direct control of the precipitation operator.

The minimum diameter of the silver halide grains in the product emulsion is determined by the diameter of the silver halide host grains being introduced. If the diameter of the host grains is held constant throughout the run, it can be appreciated that the last introduced population of silver halide host grains will constitute the minimum diameter silver halide grain population in the product emulsion. Thus, the minimum diameter of the silver halide grains present in the emulsion prepared is within the direct control of the precipitation operator.

The relative frequency of grain size occurrences in the product emulsion at the minimum and maximum grain diameters as well as intermediate grain diameters is also within the direct control of the precipitation operator. If a high proportion of silver halide grains are introduced through jet 7 to form the initial host grain population, but the availability of host grains is thereafter decreased, it can be appreciated that a silver halide emulsion can be produced in which the mode grain diameter is at least approximately the maximum grain diameter present. On the other hand, if the rate of host grain introduction is increased at the end of a run, it is clear that a silver halide emulsion can be produced in which the mode grain diameter is at least approximately the minimum grain diameter present. It is therefore further apparent that regulation of the rate of host grain introduction during the course of the run can produce an operator controlled grain size distribution in the product emulsion.

Once it is appreciated that a process is available for controlling maximum and minimum grain diameters as well as the relative frequency of grain occurrences at maximum, minimum, and intermediate grain diameters in the product emulsion, it is apparent that emulsions can be produced of grain size distributions never previously attained in the art.

Figure 6:
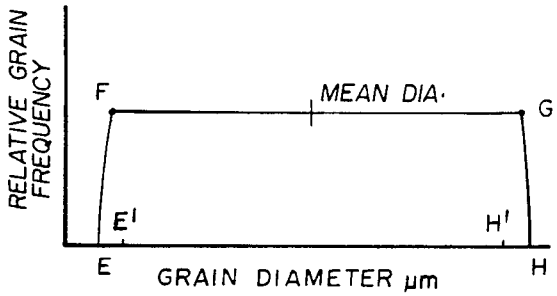
FIGS. 6, 7, 8, 9, 10, 12, 14, and 16 are plots of relative grain frequency versus grain diameter for emulsions according to this invention, with FIGS. 10, 12, and 14 additionally including a comparable curve for a control emulsion.

One novel silver halide emulsion according to this invention is illustrated by the plot of relative grain frequency versus grain diameter in FIG. 6. In looking at the grain size distribution curve EFGH, it can be seen that over an extended range of grain sizes indicated by the curve segment FG the relative grain frequency is constant. It can be appreciated that by extending the grain size range of the curve segment FG the exposure latitude of the emulsion can be increased. Thus, the curve shape EFGH is readily applicable to forming extended exposure latitude emulsions. To produce extended exposure latitude the grains of maximum diameter H should be capable of achieving a photographic sensitivity at least 2 log E greater than the grains of minimum diameter E . Generally the difference in diameters between the largest and smallest grains to achieve extended exposure latitude will be at least 7 times, with diameter differences preferably being at least 14 times.

The curve segments EF and GH are nearly vertical. The curve segment GH is defined by the size distribution of the initial population of host grains introduced into the reaction vessel. By selecting the monodispersity and mean grain diameter of the host grains in the initial grain population the slope of the curve segment GH can be controlled. In other words, the lower the coefficient of variation of the initial host grain population for a given mean grain diameter or the lower the mean grain diameter of the initial host grain population at a constant coefficient of variation, the steeper the slope of segment GH. Similarly the smallest diameter grain population in the reaction vessel at the termination of silver halide precipitation controls the shape of curve segment EF. If an invariant host grain emulsion is introduced throughout the run, it is apparent that the last introduced host grains control the shape of curve segment EF. The curve segments EF and GH can be sufficiently controlled to be considered vertical for practical purposes.

It is apparent that EH in FIG. 6 defines the total range of grain sizes present. E'H' accounts for 90 percent of the total range of grain sizes present, excluding only the very largest grains and the very smallest. Referring to the 90 percent mid-range of grain sizes present, E'H', in discussing relative grain frequencies offers a simple and convenient approach for discussing relative grain frequencies within the curve segment FG.

It is appreciated that the emulsion depicted in FIG. 6 is but an example of a family of silver halide emulsions according to this invention having a grain size distribution of relatively invariant frequency. These emulsions can be generally characterized as containing in addition to a conventional continuous phase or dispersing medium silver halide grains differing in diameter with the relative frequency of the grain size occurrences over the 90 percent mid-range of grain diameters present differing by less than 20 percent, preferably less than 10 percent, and optimally by less than 5 percent. In FIG. 6 the relative frequency of the grain size occurrences over the 90 percent mid-range of grain diameters does not differ—i.e., differs by 0 percent. In practice departures from 0 percent can result from an intentionally introduced slope or nonlinearity in curve segment FG.

In comparing the characteristic curves of radiation sensitive silver halide emulsions having a grain size distribution of relatively invariant frequency, such as illustrated by curve EFGH, with those of otherwise comparable emulsions of Gaussian grain size distributions, a number of advantages become apparent. The capability of obtaining extended exposure latitude has been noted above. In addition, it is apparent that there is a higher proportion of grains of larger diameters present. Thus, the relatively invariant grain size emulsions are somewhat higher in photograhic speed, since it is the largest grains present that first respond to exposing radiation. Further, there is a higher proportion of grains of the smaller diameters present as compared with emulsions of a Gaussian grain size distribution, although the very smallest fraction of grains sizes present in a Gaussian grain size distribution are here avoided. The emulsion with a grain size distribution of relatively invariant frequency thus achieves the advantage of producing higher densities in the upper portion of the characteristic curve at and adjacent the shoulder. At the same time, since very fine grains can be entirely absent, grains which are too small to participate usefully in imaging need not be present. Thus, for photographic applications benefiting from increased speed, higher maximum density, and longer exposure latitude the emulsions with grain size distributions of relatively invariant frequency according to this invention offer distinct advantages.

Figure 7:
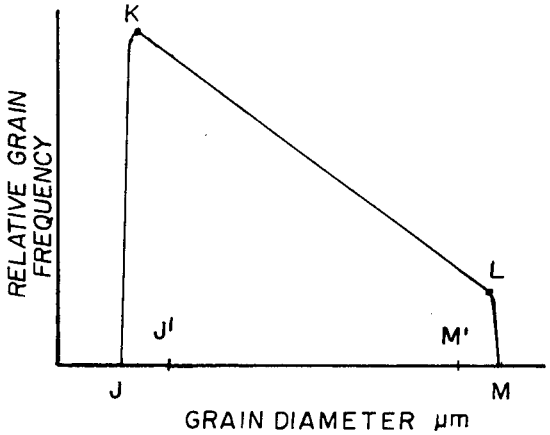

In some instances it is desirable to further increase maximum density at the expense of photographic speed. In the plot of grain size versus relative grain frequency in FIG. 7 the grain size distribution curve JKLM illustrates an emulsion capable of achieving this desired characteristic adjustment. It can be seen that the maximum frequency of grain occurrences K corresponds to grain diameters lying between J and J', where J represents the minimum diameter grains present in the emulsion and J' corresponds to a grain diameter 20% larger than the minimum diameter grains present in the emulsion, preferably no more than 10% larger than the minimum diameter grains present in the emulsion. As shown, the relative grain frequency declines linearly with increasing grain diameters until a point L is reached on the curve which is just short of the grains of maximum diameter M present in the emulsion. L lies in the grain diameter range defined by M and M', where M' represents a grain diameter only slightly less than M, typically within 5 percent and preferably within about 2 percent of M. Curve segments JK and LM depart from the vertical for the same reasons discussed above in connection with curve segments EF and GH. For practical purposes the curve segments LM and JK can be considered approximately vertical. However, it is possible for the point K to be significantly shifted toward larger grain diameters if the miminum diameter grains introduced into the reaction vessel are relatively small and conditions within the reaction vessel favor ripening.

The grain size distribution curve JKLM shown is produced by linearly increasing the rate of introduction of host silver halide grains from an initial introduction rate and abruptly terminating introduction of the host grains at the end of the run. By lowering or increasing the initial rate of host grain introduction the relative grain frequency L can be reduced or increased, respectively. Similarly by lowering or increasing the final rate of host grain introduction the relative grain frequency K can be reduced or increased, respectively. By introducing host grains at varied rates during the run the profile of curve segment KL can be rendered nonlinear. Choice of the host grain size and the duration of the run control the placement of J and M on the abscissa. Thus, the curve JKLM can be shaped at will by the operator of the preparation process.

For many applications attaining the highest possible speed in relation to an acceptable level of granularity is of substantial importance. It is generally accepted in the art that increasing mean grain diameters not only increases speed, but also increases granularity. Through the practice of this invention it is possible to increase the mean grain diameter of an emulsion without increasing the maximum grain sizes present. Therefore increases in granularity attributable to grains of increased maximum diameters are avoided.

Figure 8:
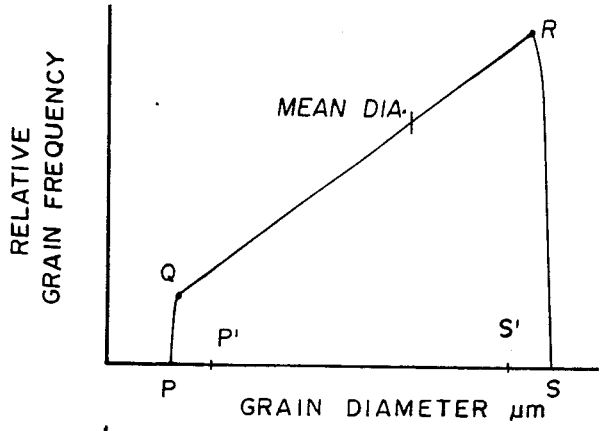

This can be illustrated by reference to the plot of grain size versus relative grain frequency shown in FIG. 8. The grain size distribution curve PQRS shows that the maximum relative grain frequency R corresponds to grain diameters lying between S and S', where S represents the maximum diameter grains present in the emulsion and S' corresponds to a grain diaemter within 5 percent and preferably within about 2 percent of the maximum diameter S. As shown the relative grain frequency declines linearly with decreasing grain diameters until a point Q is reached on the curve which is just short of the grains of minimum diameter P present in the emulsion. Q lies in the grain diameter range defined by P and P', where P represents the grains of minimum diameter present in the emulsion and P' corresponds to a grain diameter 10% larger than the minimum diameter grains present in the emulsion. It is important to notice that the mean grain diameter lies on the grain diameter abscissa much nearer S, which represents the maximum diameter grains present, than P, which represents the minimum diameter grains present. Thus, the controlled shape of the curve PQRS achieves an upward shift in the mean grain diameter without an upward shift in maximum diameters of grains present, as would result from increasing the mean grain size of similar emulsions having Gaussian grain size distributions. The curve PQRS can be achieved by initially introducing host grains at a relatively high rate into the reaction vessel and progressively reducing the rate of introduction of the host grains during the run. The remaining features of the curve PQRS as well as the manner in which the shape of the curve can be modified and controlled are essentially similar to and apparent from the preceding descriptions of curves EFGH and JKLM and, to avoid needless repetition, are not redescribed in detail.

Figure 9:
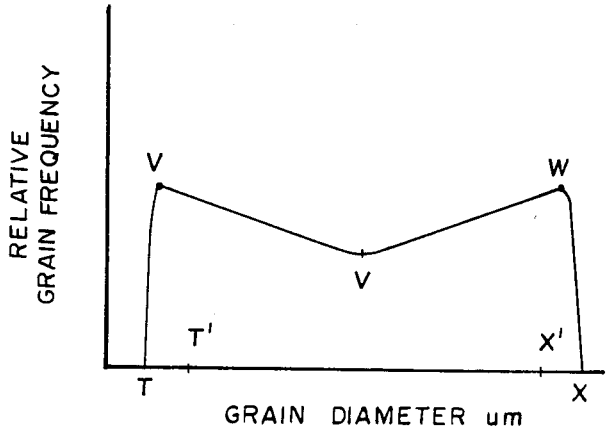

Curve JKLM shows the result of progressively increasing the rate of host grain introduction while curve PQRS shows the result of progressively decreasing the rate of host grain introduction. It is possible to increase and to decrease the rate of host grain introduction at different times during the course of a run. This is illustrated in FIG. 9. The grain size distribtion curve TUVWX shows a first maximum relative grain frequency at point U, which corresponds to a grain diameter lying between T and T', where T represents the minimum diameter grains present in the emulsion and T' corresponds to a grain diameter 10% larger than the minimum diameter grains present in the emulsion. As shown, the relative grain frequency declines approximately linearly with increasing grain diameters until a point V is reached on the curve which in this instances approximately corresponds to the mean grain diameter of the emulsion. Thereafter the relative grain frequency increases approximately linearly with increasing grain diaeters until a second maximum relative grain frequency is reached at point W, which corresponds to a grain diameter lying between X and X', where X represents the grains of maximum diameter present in the emulsion and X' represents a grain diameter only slightly less than X, typically within 5 percent and preferably within about 2 percent of X. The relative grain frequency maxima U and W need not be equal in value nor is it essential that the intermediate relative grain frequency minimum V correspond to the mean grain diameter. The curve TUVWX is similar to and should provide similar photographic advantages as the curve EFGH described above, except that the proportion of the largest and smallest grains has been increased, thereby emphasizing the photographic features described above as being attributable to grains of the largest and smallest diameters.

It is apparent that the grain size distribution curves shown in FIGS. 6 through 9 illustrate only a few of an almost limitless variety of grain size distribution curves which can be generated through the practice of this invention. One important capability offered by the process of the present invention is to generate a grain size distribution for an emulsion to satisfy any selected criterion. For example, the grain size distribution of an emulsion made by an entirely different preparation process can be exactly duplicated, if desired. It is also possible to obtain highly unusual grain size distributions to achieve unusual photographic effects. For example, occasionally it is desired to achieve so called "posterizing" effects by employing emulsions having characteristic curves that exhibit a series of steps between the toe and shoulder of the curve. Such characteristic curves have been achieved in the past by preparing several different monodisperse emulsions of widely differing mean grain diameters and blending. A characteristic curve showing repeated steps can be produced by a single emulsion prepared according to the process of this invention. More generally, however, steps or even breaks in $\gamma$ between the toe and shoulder of a characteristic curve are undesirable and require painstaking care in blending emulsions to avoid. The present invention greatly simplifies the preparation of emulsions that would otherwise require blending to produce.

In the foregoing discussion of FIGS. 6 through 9 correlations between grain size distributions and characteristic curve features have been based on the assumption that the emulsions represented are negative working emulsions. The present invention is also applicable to the preparation of direct positive emulsions. Bearing in mind that the largest grains present in a direct positive emulsion influence shoulder and adjacent portions of the characteristic curve and that the smallest grains present influence toe and adjacent portions of the characteristic curve, the advantages of the grain size distributions of FIGS. 6 through 9 in direct positive emulsions are apparent and detailed description would be needlessly repetitious.

Although the control of grain size distributions has been described in terms of continuously adjusting the rates at which host grains are introduced, it is appreciated that alternatives are possible. For example, the host grains can be introduced intermittently in a series of staggered introductions. Also, varying the mean diameters of host grains introduced constitutes an alternative or auxiliary approach to varying grain size distributions. It is, however, preferred to vary host grain introduction rates rather than mean grain diameters, since the former requires the use of only a single host grain emulsion and will therefore be generally more convenient.

The present invention has particular applicability to the preparation of direct positive emulsions which trap photogenerated electrons within the interior of the silver halide grains. The introduction of stable host grains into the reaction vessel offers a convenient approach for controlling internal electron trapping grain features.

One common approach for producing an emulsion containing silver halide grains capable of internally trapping photogenerated electrons is to introduce a dopant into the grains during precipitation. If the dopant is not entirely confined to the interior of the grains, the result is an elevated minimum density.

In the practice of the present invention the dopant can be reliably confined to the interior of the grains of the emulsion being produced by introducing into the reaction vessel the dopant already confined within the host grain population being introduced. That is, the host grain population can be doped to the level appropriate for the product emulsion to be formed and thereafter the doped host grain population is introduced into the reaction vessel along with silver and halide ions to form a shell on the host grains. Since the dopant is entirely precipitated prior to introduction into the reaction vessel, it is apparent that the dopant will be buried on the interior of the silver halide grains of the emulsion being produced by the precipitation of additional silver halide. Thus, the product emulsion grains are doped selectively in a core portion and the shell portion of the grain is substantially if not entirely free of dopant. By introducing monodisperse host grains that are substantially uniformly doped a more uniform grain to grain distribution of dopant can be realized than is possible by introducing dopant along with silver and halide ions, as is commonly undertaken. Although not necessary, it is recognized that host grains containing the dopant can, if desired, be themselves shelled prior to introduction into the reaction vessel forming the product emulsion. This provides further assurance against dopant wandering. Instead of or in addition to doping silver halide host grains as they are formed, it is recognized that the host grains can be surface chemically sensitized and then shelled by introduction into the reaction vessel with the silver and halide ions.

It is appreciated that the same techniques described above for confining a dopant to the core portions of the silver halide grains can also be applied to confining or concentrating iodide in the core portion of the silver halide grains.

As employed herein the term "shell" is employed in its art recognized sense to indicate a grain portion surrounding a remaining, "core" grain portion. The function of a shell in a direct positive emulsion is to prevent access to internally trapped electrons during development. The terms "core" and "shell", whether employed singly or in combination, are not intended in themselves to imply any particular process for their formation.

The core-shell grains produced by the procedures described above can exhibit any desired maximum grain diameter, minimum grain diameter, and any desired size frequency distribution. For example, the core-shell emulsions produced can exhibit either conventional grain size distributions or any of the grain size distributions of FIGS. 6 through 9.

Independently of the core-shell grain size distributions, it is further appreciated that the core diameters and shell thicknesses can be independently controlled. For example, in a preferred form of the invention a monodisperse host grain emulsion, the grains of which have been substantially uniformly doped, surface chemically sensitized, or both, is introduced into the reaction vessel along with silver and halide ions. The overall size distribution of the resulting core-shell silver halide grains produced is controlled by considerations already discussed above. However, it should be noted that the core portions of the grains are substantially similar in diameter even though the overall diameters of the core-shell grains differ. In other words, a core-shell grain population is produced with substantially uniform cores and any desired size frequency distribution.

Instead of forming a core-shell emulsion with a substantially uniform core size, it is possible to form a substantially uniform shell thickness. The host grain emulsion is prepared with the desired dopant (if any), halide content, sensitivity, and grain size distribution and then abruptly introduced into the reaction vessel together with silver and halide ions. The resulting core-shell emulsion can have any desired grain size distribution, and the shell portions of the grains will be substantially uniform in thickness. This preparation approach allows the internal electron trapping capability of the grains to be varied as a direct function of the host or core grain diameter.

Having described processes for producing core-shell emulsions of either substantially uniform core diameters or substantially uniform shell thicknesses, it is apparent that modifications of the above processes can be employed to produce both core diameters and shell thicknesses that are independently either substantially uniform or varied. For example, the abrupt introduction of a monodisperse host grain emulsion into the reaction vessel is capable of producing a core-shell emulsion of substantially uniform core diameters and shell thicknesses while the gradual introduction of a polydisperse host emulsion into the reaction vessel will produce a core-shell emulsion with differing core diameters and shell thicknesses.

It is a significant feature of the present invention that host grains are provided by a silver halide emulsion which consists essentially of only stable silver halide grains in addition to the dispersing medium or continuous phase—i.e., all of the conventional non-silver halide components of an emulsion. The host grain emulsion is to be contrasted with a freshly precipitated silver halide emulsion, wherein the size, shape, and number of silver halide grains is in transition. A stable silver halide grain population can be insured by performing a separate physical ripening step following precipitation of the host grain emulsion. However, sufficient physical ripening to achieve a stable silver halide grain population does not necessarily require a separate process step. For example, precipitation of the host grain emulsion, washing, and then bringing the emulsion to a concentration and temperature consistent with its use as a feed stock for precipitation of the emulsions of this invention is generally sufficient in itself to create a stable host grain population.

It is, of course, apparent that silver halide grains which ripen out (i.e., dissolve) in the reaction vessel are unable to act as host grains. It is therefore important that the host grains be chosen to be stable in the reaction vessel. Grain stability within reaction vessels has been extensively studied and is recognized to be influenced by a variety of parameters, such as temperature, silver ion concentration, halide composition, and the presence or absence of silver halide solvents or grain growth restrainers. By simply increasing the size of the host grains introduced their stability can be increased without otherwise modififying the conditions present in the reaction vessel. Silver bromide and silver bromoiodide emulsions with mean grain diameters above about 0.02 μm can provide a stable host grain population. Though seldom employed in photographic emulsions, silver iodide grains, because of the substantially lower levels of silver iodide solubility, can exhibit still smaller mean grain diameters when employed as a host grain emulsion. Emulsions containing substantial amounts of chloride, including silver chloride, silver chlorobromide, and silver chlorobromoiodide emulsions, should have mean grain diameters of at least about 0.05 μm because of the higher solubilities of silver chloride. Under commonly encountered reaction vessel conditions physically ripened emulsions with mean grain diameters above about 0.1 μm are capable of providing a stable host grain population independent of the grain halide content, and such emulsions are preferred for use as host grain emulsions in the practice of the invention. As discussed above, the minimum desired grain diameters in the product emulsion determines how large the host grains can be when introduced into the reaction vessel.

The host grains can be of any photographically useful halide composition and can be bounded by {111}, {100}, or {110} crystal planes or combinations of these crystal planes. The grains can be regular or irregular in shape and are specifically contemplated to include irregular twinned grains, such as tabular grains. The host grains can be polydisperse, but are preferably monodisperse having a coefficient of variation of less than 20% and most preferably less than 10%. Subject to the considerations noted above, the host grains can be of any convenient conventional type. Physically ripened monodisperse silver halide emulsions prepared by batch double jet precipitation techniques constitute a preferred source of stable host grains for use in the practice of this process. However, the manner in which the host grains are prepared is considered to be a matter of choice rather than a necessary part of this invention.

Introduction of the silver and halide ions into the reaction vessel along with the stable host grains can be undertaken following teachings well known in the art relating to the batch double jet precipitation of silver halide emulsions. Ions of a single halide or a combination of halides can be introduced into the reaction vessel. The silver and halide ion introductions can be achieved by the introduction of soluble salts, such as silver nitrate and alkali halide. Alternatively the silver and halide ions can be introduced in the form of silver halide grains limited in size so that they are readily ripened out. Lippmann emulsions, such as those having mean grain diameters in the range of about 0.01 μm or less, are particularly suited for supplying silver and halide ions. The halide ions will normally be selected to correspond to the halide ions of the host grains, but, as is well recognized in the art, they can be independently selected. In fact, anions other than halide ions known to form photographically useful silver salt emulsions, such as thiocyanate, cyanide, and acetate anions, can be substituted in whole or in part for halide ions without materially altering the process disclosed.

Introduction rates of the silver and halide ions can be similar to those employed in conventional double jet precipitation processes. The silver and halide ion introductions into the reaction vessel are often held constant throughout double jet precipitations, but can be varied, if desired. It is often convenient to accelerate the rate of introduction of silver and halide ions during the course of the run, such as taught by Wilgus German OLS No. 2,107,118 and Irie et al U.S. Pat. No. 3,650,757, which disclose increasing the flow rates of silver and halide salt solutions, increasing the concentrations of silver and halide salt solutions, and increasing the ratio of one halide to another. Since the host grains are intended to provide the sole stable grain population in the reaction vessel, flow rates of silver and halide ions are limited to avoid renucleation in the manner taught by Wilgus and Irie et al. However, since additional host grains are being introduced into the reaction vessel throughout the run, even larger accelerations of silver and halide ion introduction rates are possible without encountering renucleation. Adjustment of silver and halide ion introduction rates can be employed as an auxiliary adjustment of grain size distributions, if desired.

Conventional sensitizing compounds, such as compounds of copper, thallium, lead, bismuth, cadmium and Group VIII noble metals, can be present in the reaction vessel during precipitation of the silver halide emulsion, as illustrated by Arnold et al U.S. Pat. No. 1,195,432, Hochstetter U.S. Pat. No. 1,951,933, Trivelli et al U.S. Pat. No. 2,448,060, Overman U.S. Pat. No. 2,628,167, Mueller et al U.S. Pat. No. 2,950,972, Sidebotham U.S. Pat. No. 3,488,709 and Rosecrants et al U.S. Pat. No. 3,737,313. As discussed above, internal dopants, such as the identified metals, are preferably incorporated in the host grains prior to introduction into the reaction vessel. However, Hoyen U.S. Pat. No. 4,395,478 discloses reduced rereversal advantages for including polyvalent metal ion dopants in the shell portions of core-shell emulsions. It is also recognized that spectral sensitizing dyes can be introduced into the reaction vessel, as illustrated by Locker U.S. Pat. No. 4,183,756 and Locker et al U.S. Pat. No. 4,225,666.

The host grains and individual reactants can be added to the reaction vessel through surface or sub-surface delivery tubes by gravity feed or by delivery apparatus for maintaining control of the rate of delivery and the pH and/or pAg of the reaction vessel contents, as illustrated by Culhane et al U.S. Pat. No. 3,821,002, Oliver U.S. Pat. No. 3,031,304 and Claes et al, *Photographische Korrespondenz,* 102 Band, Number 10, 1967, p.162. In order to obtain rapid distribution of the host grains and reactants within the reaction vessel, specially constructed mixing devices can be employed, as illustrated by Audran U.S. Pat. No. 2,996,287, McCrossen et al U.S. Pat. No. 3,342,605, Frame et al U.S. Pat. No. 3,415,650, Porter et al U.S. Pat. No. 3,785,777, Saito et al German OLS No. 2,556,885 and Sato et al German OLS No. 2,555,364. An enclosed reaction vessel can be employed to receive and mix reactants upstream of the main reaction vessel, as illustrated by Forster et al U.S. Pat. No. 3,897,935 and Posse et al U.S. Pat. No. 3,790,386. Ultrafiltration of the emulsion can be undertaken while it is being precipitated, as taught by Mignot U.S. Pat. No. 4,334,012 and Brown et al U.S. Pat. No. 4,336,328. The above conventional reaction vessel arrangements can be readily adapted for the introduction of host grains merely by providing an additional jet at or near the location that the silver and halide ions are introduced.

Conventional dispersing media and proportions of dispersing media in the physically ripened host grain emulsion, silver and halide ion source or sources, and the reaction vessel at start up are employed. Since the dispersing medium initially present in a reaction vessel at the beginning of a conventional double jet batch precipitation can vary from roughly 10 to 90 percent, more typically from 20 to 80 percent, of the total dispersing medium present in the emulsion at the end of precipitation, it is appreciated that the introduction of a host grain emulsion can be readily accomodated without departing from conventional dispersing media ranges for double jet batch precipitations. Preferably the physically ripened host grain emulsion and the product emulsion contain in an aqueous continuous phase a peptizer, such as gelatin or a gelatin derivative. The advantage of employing peptizers increases with increasing grain sizes. Peptizers need not be present in relatively fine grain emulsions.

Once precipitation has been completed by the processes of this invention the product emulsions can be subsequently washed, sensitized, and prepared for conventional photographic uses according procedures well known in the art, such as illustrated by *Research Disclosure,* Vol. 176, December 1978, Item 17643, here incorporated by reference. *Research Disclosure* is published at Emsworth Studios, 535 West End Avenue, New York, N.Y. 10024.

EXAMPLES

The invention can be better appreciated by reference to the following specific examples:

CONTROL A

This control is provided for the purpose of comparing an emulsion having a Gaussian or normal grain size distribution with the emulsions of this invention.

Figure 10:
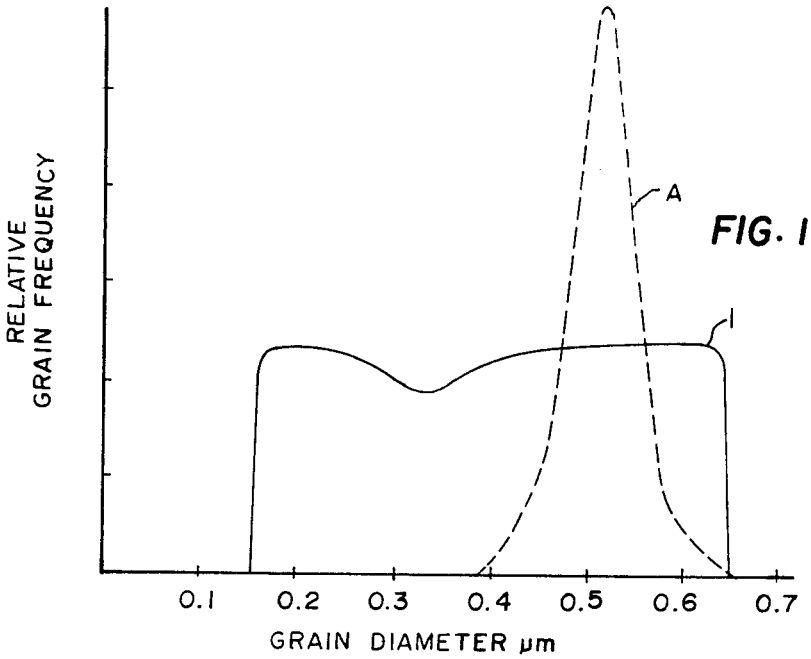

To 5.0 liters of a vigorously stirred 3% bone gelatin solution were added by double jet a 2.0 M silver nitrate solution and a 2.0 M potassium bromide solution while maintaining the precipitation vessel at 70° C. and pAg 8.15. The addition of the bromide and silver nitrate solutions was continued over a period of 30 minutes in an accelerated linear flow rate profile (46 ml/min at start and 212 ml/min at finish). A total of 7.74 moles of silver bromide was precipitated. At the conclusion of the addition, the emulsion was cooled to 35° C. and combined with a phthalated gelatin solution (200 g gel/1.5 l DW [distilled water]). The emulsion was washed twice by the coagulation washing procedure of Yutzy and Russell U.S. Pat. No. 2,614,929. After completion of the washing sequence, the emulsion was combined with a bone gelatin solution (170 g gel/1.0 l DW) and adjusted to pH 5.5/pAg 8.3. Curve A in FIG. 10 shows the size frequency profile of the emulsion grains.

Figure 11:
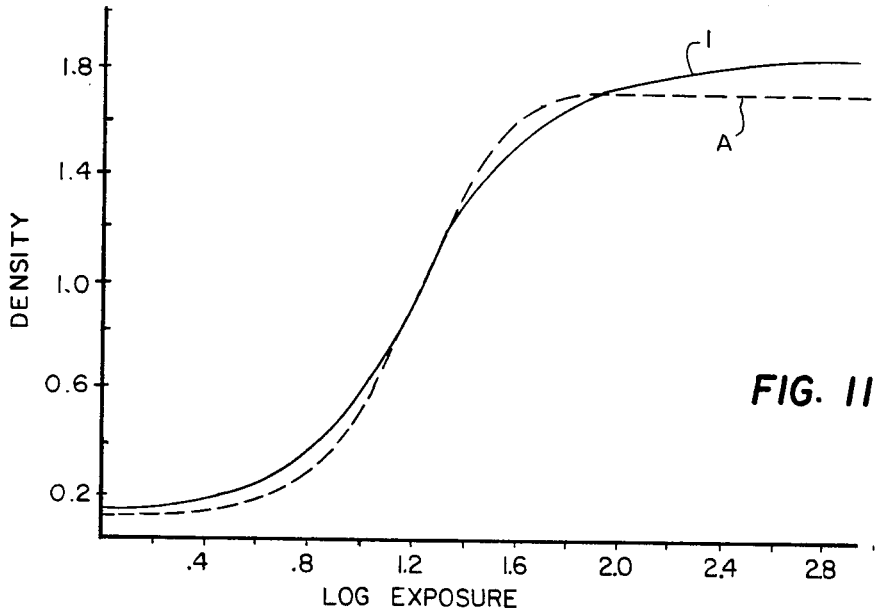
FIGS. 11, 13, and 15 present characteristic curves of emulsions according to this invention, each also including the characteristic curve of a conventional emulsion.

The emulsion was optimally sulfur and gold sensitized and coated on a film support at a coverage of 2.15 grams of silver and 4.30 grams of dispersing medium (gelatin) per square meter. After drying the coating, the resulting photographic element was exposed for 1 second by a 500 watt, 3000° K. light source through a step tablet and processed for 6 minutes at 28° C. in a hydroquinone-Elon® (N-methylaminophenol hemisulfate) developer. Curve A in FIG. 11 is the characteristic curve obtained.

EXAMPLE 1

This example illustrates an emulsion having a relatively invariant grain size frequency and compares the grain size distribution and the photographic characteristics of this emulsion with the Control A Gaussian grain size distribution emulsion.

The host grain emulsion used in this example and the two examples which follow was prepared by conventional double jet procedures which could easily provide physically ripened, stable silver halide grains. The following solutions were prepared:

| | |
|---|---|
| SOLUTION A | |
| Bone gelatin | 180 g |
| DW | 6.0 l |
| Temperature | 70° C. |
| pAg | 7.6 |
| SOLUTION B | |
| KBr | 952 g |
| DW to total volume | 4.0 l |
| SOLUTION C | |
| $AgNO_3$ | 1224 g |
| DW to total volume | 3.6 l |

Solutions B (75 ml/min) and C (75 ml/min) were added to Solution A for 3 minutes while maintaining the temperature at 70° C. and the pAg at 7.6. At the end of 3 minutes, the pAg in the vessel was adjusted to 8.2 with Solution B. After that, Solutions B and C were again added to the vessel over a period of 26 minutes in an accelerated linear flow rate profile (75 ml/min at start and 150 ml/min at finish) while maintaining the temperature at 70° C. and the pAg at 8.2. At the end of the run, the emulsion was cooled to 35° C. and an aqueous phthalated gelatin solution (180 g gel/1.0 l DW) was added. The emulsion was washed twice by the coagulation process of Yutzy and Russell U.S. Pat. No. 2,614,929. After completion of the washing sequence, the emulsion was combined with an aqueous solution of bone gelatin (105 g gel/1.0 l DW) and adjusted to pH 6.2/pAg 8.2.

The silver bromide host grain emulsion prepared by the above procedure had a mean grain diameter of 0.15 μm with a minimum grain diameter of 0.12 μm and a maximum grain diameter of 0.17 μm. The morphology of this host grain emulsion was essentially octahedral. The host grain emulsion was used in the following step.

| | |
|---|---|
| SOLUTION D | |
| Bone gelatin | 150 g |
| DW | 5.0 l |
| Temperature | 70° C. |
| SOLUTION E | |
| Host grain emulsion (0.726 Kg/mole Ag) | 363 g |
| DW to total volume | 2.5 l |
| Temperature | 40° C. |
| SOLUTION F | |
| $AgNO_3$ | 1564 g |
| DW to total volume | 4.6 l |
| SOLUTION G | |
| KBr | 1095 g |
| DW to total volume | 4.6 l |

After 125 ml of Solution E was added to Solution D, the pAg in Solution D was adjusted to 8.15 with Solution G at 70° C. Solution E was added to solution D at 25 ml/min over a period of 80 minutes while simultaneously adding Solutions F and G at the following accelerated flow rate sequence.

| Time (Min) | 0 | 10 | 20 | 30 | 40 | 50 | 60 | 70 | 80 |
|---|---|---|---|---|---|---|---|---|---|
| Rate (ml/min) | 0 | 3.9 | 10.6 | 20.8 | 35.3 | 55 | 80 | 112 | 151 |

The precipitation vessel was maintained at 70° C. and pAg 8.15 during the run. At the end of the run, the emulsion was cooled to 35° C. and an aqueous phthalated gelatin solution (205 g gel/0.8 l DW) was added. The emulsion was washed twice by the coagulation process of Yutzy and Russell U.S. Pat. No. 2,614,929. After completion of the washing sequence, the emulsion was combined with an aqueous solution of bone gelatin (177 g gel/0.5 l DW) and adjusted to pH 5.5/pAg 8.3.

The emulsion was optimally sulfur and gold sensitized and then coated to the same silver coverage as the Control A emulsion and similarly exposed and processed.

Curve 1 in FIG. 10 shows the grain size distribution and Curve 1 in FIG. 11 shows the characteristic curve for this emulsion. In comparing Curves A and 1 in FIGS. 10 and 11 the effect of grain size distribution differences on the characteristic curves produced by the Control and Example emulsions can be appreciated. From FIG. 10 it is apparent that Curve 1 shows more grains than Curve A of the largest diameters. In FIG. 11 it can be seen that this translates into higher speed for characteristic Curve 1, observable in the toe portion of the characteristic curve, which is where speed is measured for negative working emulsions. Going back to FIG. 10, it can be seen that Curve 1 shows a higher proportion of smaller grains than Curve A. In FIG. 11 it can be seen that this translates into higher densities in the shoulder of the characteristic Curve 1 as compared to the characteristic Curve A. In comparing characteristic Curves 1 and A in FIG. 11 it is further apparent that $\gamma$ is lower and exposure latitude extended for the example emulsion. All of these characteristic curve differences exhibited by the example emulsion can be highly advantageous.

EXAMPLE 2

This example illustrates an emulsion having a disproportionately high frequency of grains of above a defined minimum grain diameter and compares the grain size distribution and the photographic characteristics of this emulsion with the Control A Gaussian grain size distribution emulsion.

The following solutions were prepared:

| | |
|---|---|
| SOLUTION A | |
| Bone gelatin | 150 g |
| DW | 5.0 l |
| Temperature | 70° C. |
| pAg | 8.15 |
| SOLUTION B | |
| Host grain emulsion of Example 1 | 290 g |
| DW to total volume | 4.0 l |
| Temperature | 40° C. |
| SOLUTION C | |
| $AgNO_3$ | 714 g |
| DW to total volume | 4.2 l |
| SOLUTION D | |
| KBr | 500 g |

-continued

| | |
|---|---|
| DW to total volume | 4.2 l |

Solution B was added to Solution A over a period of 80 minutes in an accelerated linear flow rate profile (0 ml/min at start and 100 ml/min at finish) while simultaneously adding Solutions C and D at the following flow rate sequence.

| Time (Min) | 0 | 20 | 30 | 40 | 50 | 60 | 70 | 80 |
|---|---|---|---|---|---|---|---|---|
| Rate (ml/min) | 0 | 4.4 | 12 | 26 | 48 | 82 | 129 | 195 |

The precipitation vessel (Solution A) was maintained at 70° C. and pAg 8.15 during the run. At the end of the run, the emulsion was cooled to 35° C. and an aqueous phthalated gelatin solution (130 g gel/0.6 l DW) was added. The emulsion was washed twice by the coagulation process of Yutzy and Russell U.S. Pat. No. 2,614,929. After completion of the washing sequence, the emulsion was combined with an aqueous solution of bone gelatin (81 g gel/0.15 l DW) and adjusted to pH 5.5/pAg 8.3.

The emulsion was optimally sulfur and gold sensitized and then coated to the same silver coverage as the Control A emulsion and similarly exposed and processed.

Figure 12:
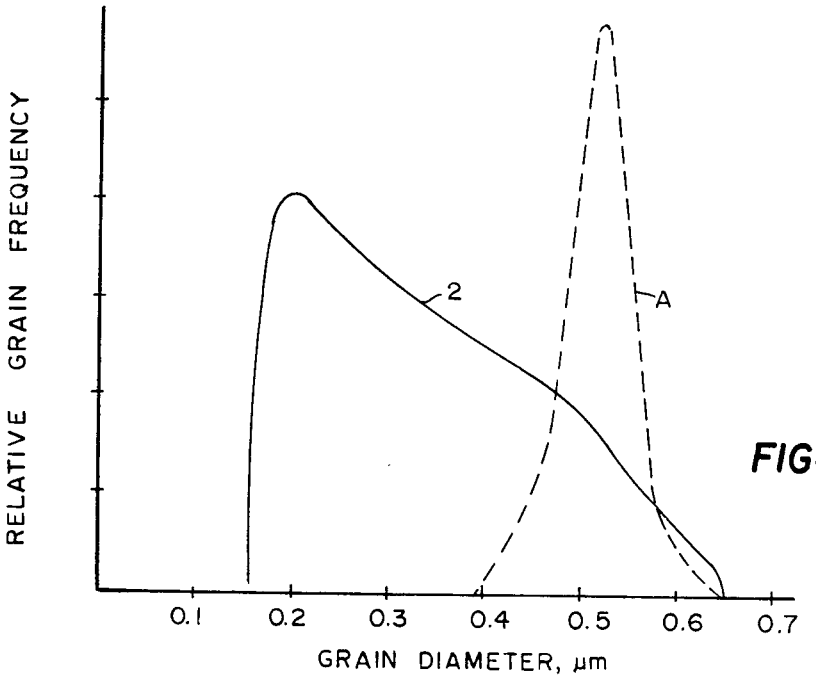
Figure 13:
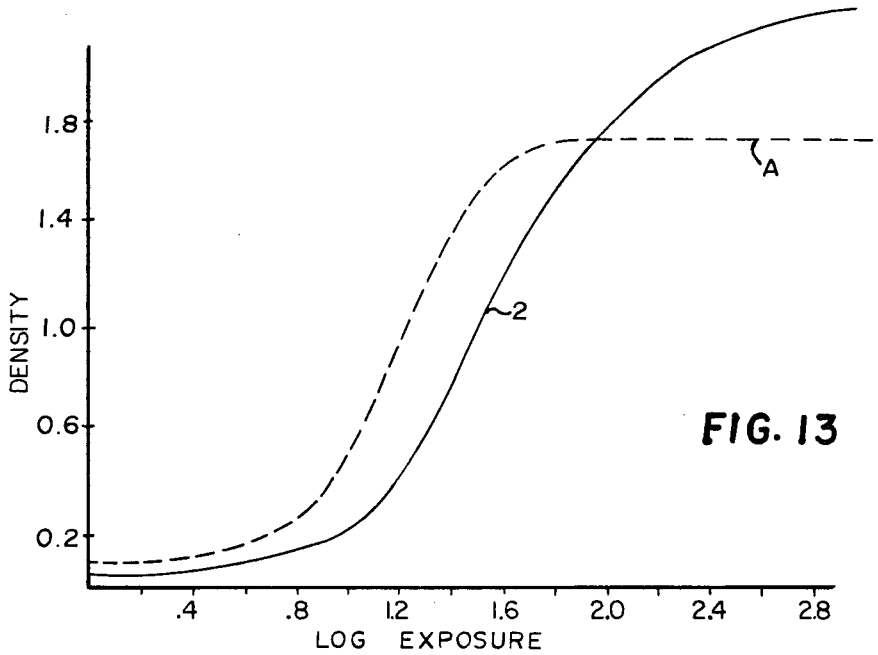

By comparing Curve 2 in FIG. 12, which shows the grain size distribution of the emulsion of this example, with Curve A, which again shows the grain size distribution of the emulsion of Control A, it is apparent that there is a higher proportion of grains of smaller diameters in the emulsion of this example. Turning to FIG. 13, the characteristic Curve 2 of the emulsion of this example as a result of the grain size distribution difference exhibits a higher maximum density and a longer exposure latitude. The emulsion of this example is somewhat slower than the Control A emulsion. For applications in which higher maximum density and extended exposure latitude are more important than attaining the highest possible speed, the emulsion of this example is superior to the Control A emulsion.

EXAMPLE 3

This example illustrates an emulsion having a disproportionately high frequency of grains of just below a defined maximum grain diameter and compares the grain size distribution and the photographic characteristics of this emulsion with the Control A Gaussian grain size distribution emulsion.

The following solutions were prepared:

| | |
|---|---|
| SOLUTION A | |
| Bone gelatin | 150 g |
| DW | 5.0 l |
| Temperature | 70° C. |
| pAg | 8.15 |
| SOLUTION B | |
| Host grain emulsion of Example 1 | 290 g |
| DW to total volume | 4.0 l |
| Temperature | 40° C. |
| SOLUTION C | |
| $AgNO_3$ | 2515 g |
| DW to total volume | 4.2 l |
| SOLUTION D | |
| KBr | 1499 g |

-continued

| | |
|---|---|
| DW to total volume | 4.2 l |

Solution B was added to Solution A over a period of 80 minutes in a decelerated linear flow rate profile (100 ml/min at start and 0 ml/min at finish) while simultaneously adding Solutions C and D at the following flow rate sequence.

| Time (Min) | 0 | 10 | 20 | 30 | 40 | 50 | 60 | 70 | 80 |
|---|---|---|---|---|---|---|---|---|---|
| Rate (ml/min) | 0 | 4.9 | 12.7 | 23.7 | 38.3 | 57.0 | 79.7 | 106 | 136 |

The precipitation vessel (Solution A) was maintained at 70° C. and pAg 8.15 during the run. At the end of the run, the emulsion was cooled to 35° C. and an aqueous phthalated gelatin solution (300 g gel/2.0 l DW) was added. The emulsion was washed twice by the coagulation washing procedure of Yutzy and Russell U.S. Pat. No. 2,614,929. After completion of the washing sequence, the emulsion was combined with an aqueous solution of bone gelatin (258 g gel/1.5 l DW) and adjusted to pH 5.5/pAg 8.3.

The emulsion was optimally sulfur and gold sensitized and then coated to the same silver coverage as the Control A emulsion and similarly exposed and processed.

Figure 14:
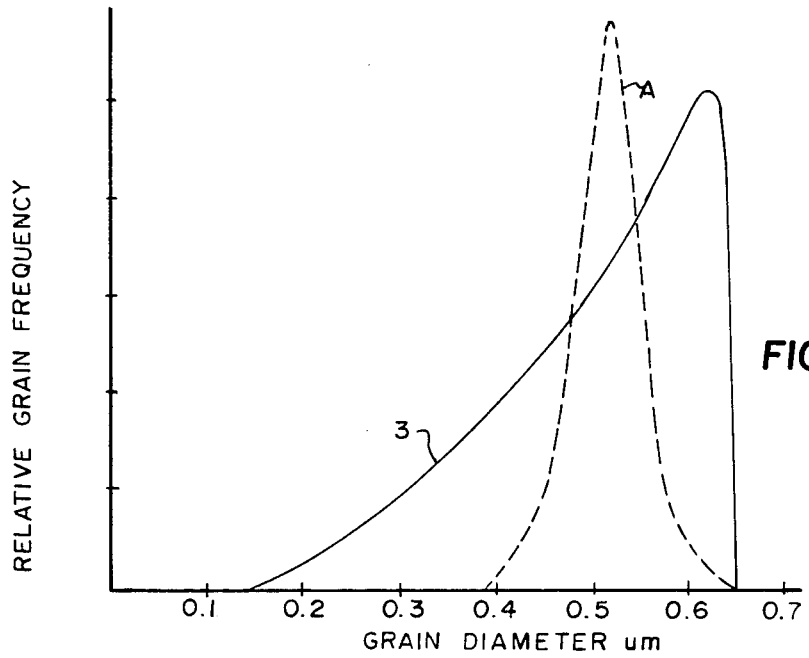
Figure 15:
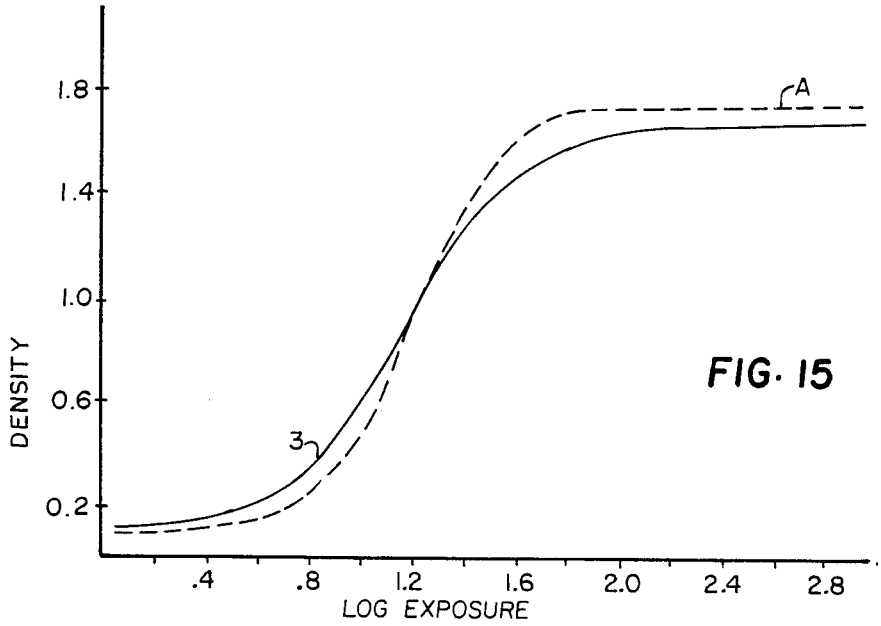

In comparing the size distribution Curve A of the Control A emulsion in FIG. 14 with the size distribution Curve 3 of the emulsion of this example, it can be seen that the proportion of grains at and near the maximum grain diameter has been increased without increasing the maximum grain diameter of the example emulsion above that of the control emulsion. The effect of this grain size distribution differences can be seen in FIG. 15, wherein characteristic Curve 3 corresponds to the emulsion of this example and characteristic Curve A is again shown for the Control A emulsion. A higher photographic speed for the emulsion of this example is apparent in comparing the two portions of the characteristic curves. This is an advantage for photographic applications requiring higher speeds. It is to be noted that the increase in photographic speed has been obtained without increasing the maximum grain diameter of the emulsion of this example above that present in the control emulsion.

EXAMPLE 4

This example illustrates the preparation of a negative-working polydisperse normal grain size distribution silver halide emulsion according to this invention using a continuous double jet precipitation process as compared to a batch double jet precipitation process.

A monodisperse 0.15 μm octahedral silver bromide host grain emulsion was prepared by a conventional double jet precipitation procedure, physically ripened, and washed. The host grain emulsion was used as indicated in the following emulsion making process. Solutions A–N were prepared.

| | |
|---|---|
| Solution A | |
| Host grain emulsion (0.15 μm AgBr emulsion 0.861 Kg/mol Ag) | 62.0 g |
| Aqueous gelatin | 1140 ml |

-continued

| | |
|---|---|
| solution (3% by wt bone gelatin) | |
| Total volume | 1.2 l |
| Temperature | 70° C. |
| pAg | 8.2 |
| Solution B | |
| Sodium bromide | 816 g |
| DW | 2745 g |
| Total volume | 3.0 l |
| Solution C | |
| Silver nitrate | 1346 g |
| DW | 2691 g |
| Total volume | 3.0 l |
| Solution D | |
| Bone gelatin | 494 g |
| DW to total volume | 15.0 l |
| Temperature | 70° C. |
| pAg | 8.2 |
| Solution E | |
| Host grain emulsion | 560 g |
| DW to total weight | 975 g |
| Temperature | 37° C. |

Solutions B (20 ml/min), C (20 ml/min), D (73 ml/min) and E (7.2 ml/min) were added to Solution A at the flow rates indicated while the emulsion product was continuously withdrawn at the same flow rate of the total input streams to maintain a constant reactor volume (1.2 l). The continuous precipitation reactor had a residence time ($\tau$) of 10 minutes and was maintained at 70° C. and pAg 8.2. Polydisperse emulsion was collected between $7\tau$ and $13\tau$ (7.2 l, 3.46 moles). The emulsion was cooled to 35° C. and phthalated gelatin (138 g) was added. The emulsion was coagulated at pH 3.2, chill-set, and the supernatant was decanted. The emulsion was redispersed at pH 5.0 and coagulated and washed once again. After the second coagulation washing, the emulsion was redispersed and combined with bone gelatin to bring the gel concentration to 40 g gelatin/mole Ag and then adjusted to pAg 8.2 and pH 6.2.

Figure 16:
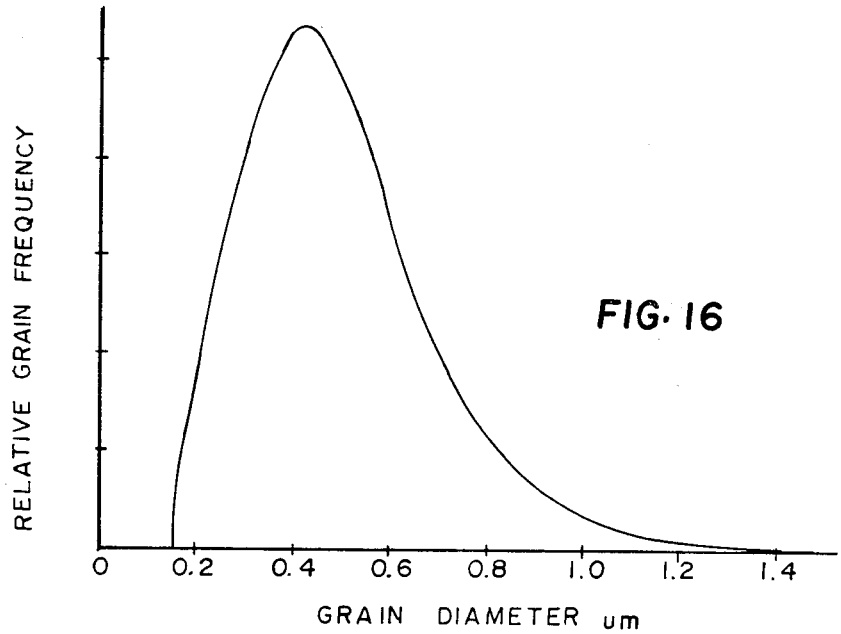

The particle size frequency distribution of this emulsion was determined by the disc centrifuge technique (on an area basis) and is shown in FIG. 16. The emulsion had an overall mean grain diameter of 0.39 μm and a coefficient of variation of 43%.

EXAMPLE 5

This example and the two examples which follow illustrate the preparation of reduction and gold fogged, internal electron trapping polydisperse emulsions.

Internally doped monodisperse host grains of 0.12 μm mean diameter were prepared as follows:

| Solution A | | Solution B | |
|---|---|---|---|
| Bone gelatin | 102 g | KBr | 1339 g |
| DW | 6000 ml | DW | 3263 ml |
| Temperature | 70° C. | Total volume | 3750 ml |
| pAg | 8.15 | | |
| **Solution C** | | **Solution D** | |
| $AgNO_3$ | 1734 g | $K_3IrBr_6$ | 3.26 g |
| DW | 3002 ml | Total volume (with a 3.5 N KBr, pH 2.7 solution) | 300 ml |
| Total volume | 3400 ml | | |
| **Solution E** | | | |
| Phthalated gelatin | 204 g | | |
| DW to total volume | 1500 ml | | |

Solutions B (200 ml/min) and C (200 ml/min) were added to Solution A while maintaining the temperature at 70° C. and the pAg at 8.15. After two minutes, solution D was added to the vessel at 20 ml/min. At the conclusion of the precipitation step (when Solution C was exhausted), the vessel was cooled to 40° C. and Solution E was added. The emulsion was washed three times by the coagulation washing procedure of Yutzy and Russell U.S. Pat. No. 2,614,929. After completion of the washing sequence, the emulsion was combined with an aqueous solution of bone gelatin (270 g gelatin/1.5 l DW), adjusted to pH 6.2/pAg 8.2, and used in the following step.

| Solution A | | Solution B | |
|---|---|---|---|
| 3% by weight aqueous bone gel solution | 2000 ml | KBr | 2678 g |
| | | DW | 6526 ml |
| | | Total volume | 7500 ml |
| Temperature | 70° C. | | |
| pAg | 8.15 | | |
| **Solution C** | | **Solution D** | |
| $AgNO_3$ | 3825 g | 3% by weight aqueous bone gel soln | |
| DW | 6621 ml | | |
| Total volume | 7500 ml | Temperature | 70° C. |
| | | pAg | 8.15 |
| **Solution E** | | | |
| Host grain emulsion (0.94 Kg/mole Ag) | 2625 g | | |
| DW to total volume | 5250 g | | |

Solutions B (50 ml/min), C (50 ml/min), D (330 ml/min), and E (70 ml/min) were added to solution A while the emulsion product was continuously withdrawn at the same flow rate as the total input streams to maintain a constant reactor volume (2 l). The continuous precipitation reactor had a residence time ($\tau$) of 4 minutes and was maintained at 70° C. and pAg 8.15. Polydisperse emulsion (16 l, 6.4 moles) was collected at steady state. After adding at 35° C. an aqueous phthalated gelatin solution (256 g gel/2.0 l DW), the emulsion was washed three times. An aqueous bone gelatin solution (160 g gel/l DW) was added and the emulsion was adjusted to pH 6.2/pAg 8.2. This silver bromide emulsion (80 mg Ir/mole Ag) had an overall mean grain diameter of 0.19 μm with a coefficient of variation of 61%.

The emulsion was reduction and gold fogged by heating the emulsion for 60 minutes at 70° C. in the presence of thiourea dioxide (3.2 mg/mole Ag) and potassium tetrachloroaurate (10 mg/mole Ag). The emulsion was coated on a film support (4.61 g Ag/m$^2$, 4.28 g gel/m$^2$), exposed (30 sec, 500 w, 300° K.) and processed in an Elon®-hydroquinone developer for 3 minutes. A direct positive image with a gamma of 1.58 and a $D_{max}$ of 2.23 was obtained.

Subsequent chemical sensitization variations have been carried out. The speed of the emulsion can be decreased by changing the chemical sensitizer levels (up to 25.6 mg thiourea dioxide/10.0 mg $KAuCl_4$/mole Ag) with no appreciable changes in gamma or $D_{max}$.

EXAMPLE 6

This example demonstrates a double jet, batch precipitation method of making a polydisperse emulsion according to the invention.

The following solutions were prepared:

| Solution A | Solution B |
|---|---|

-continued

| | | | |
|---|---|---|---|
| Bone gelatin | 150 g | KBr | 952 g |
| DW | 5.0 l | DW | 3654 ml |
| Temperature | 70° C. | Total volume | 4.0 l |
| Solution C | | Solution D | |
| $AgNO_3$ | 1360 g | Host grain emulsion | 375 g |
| DW | 3688 ml | of Example 5 | |
| Total volume | 4.0 l | DW to total volume | 4.0 l |
| | | Temperature | 40° C. |

After 10 ml of Solution D was added to Solution A, the pAg of Solution A was adjusted to 8.15 with Solution B at 70° C. Solution D was added to Solution A at 50 ml/min over a period of 60 minutes while simultaneously adding Solutions B and C at the following accelerated flow rate sequence:

| | | | | | | | |
|---|---|---|---|---|---|---|---|
| Time (min) | 0 | 10 | 20 | 30 | 40 | 50 | 60 |
| Rate (ml/min) | 0 | 6 | 17.5 | 36.5 | 65 | 104.5 | 157.5 |

The precipitation vessel was maintained at 70° C. and pAg 8.15 during the run. At the end of the run, the emulsion was cooled to 40° C. and an aqueous phthalated gelatin solution (256 g gel/1.5 l DW) were added. The emulsion was coagulation washed twice by the procedure of Yutzy and Russell U.S. Pat. No. 2,614,929. After completion of washing, the emulsion was combined with an aqueous solution of bone gelatin (96 g gel/l DW) and adjusted to pH 6.2/pAg 8.2. The final emulsion contained 15 mg Ir/mole Ag and had an overall mean grain size diameter of 0.22 μm with a coefficient of variation of 46%.

EXAMPLE 7

This example illustrates the preparation of an extended exposure latitude photographic element following the practice of this invention.

| | | | |
|---|---|---|---|
| Solution A | | Solution B | |
| Bone gelatin | 51 g | KBr | 670 g |
| DW | 3000 ml | DW | 1875 ml |
| Temerature | 70° C. | | |
| pH | 5.61 | | |
| Solution C | | Solution D | |
| $AgNO_3$ | 867 g | $K_3IrCl_6.3H_2O$ | 1.8 g |
| DW (total vol) | 1700 ml | DW (total vol) | 180 ml |

Solution D was added to Solution A with stirring 5 minutes before start of precipitation. Solutions B (100 ml/min) and C (100 ml/min) were added to Solution A while maintaining the temperature at 70° C. and the pAg at 8.0. When Solution C was exhausted, the precipitation was halted; the vessel was cooled to 40° C. and an aqueous phthalated gelatin solution (102 g gel/0.75 l DW) was added. The emulsion was coagulated three times, by lowering the pH, decanting, and re-dispersing at pH 5.0. The emulsion was combined then with an aqueous bone gelatin solution (135 g gel/0.75 l DW), adjusted to pH 6.2/pAg 8.2, and used in the following step.

| | | | |
|---|---|---|---|
| Solution E | | Solution F | |
| Bone gelatin | 150 g | KBr | 952 g |
| DW | 5000 ml | DW (total vol.) | 4000 ml |
| Temperature | 70° C. | | |

-continued

| | | | |
|---|---|---|---|
| pH | 5.64 | | |
| Solution G | | Solution H | |
| $AgNO_3$ | 1360 g | Host grain emulsion | 354.4 g |
| DW (total vol) | 4000 ml | (0.89 Kg/mole Ag) | |
| | | DW (total vol) | 4000 ml |

Solution E was adjusted to pAg 8.15 with Solution F after adding 10 ml of Solution H. Then Solution H was added to Solution E at 50 ml/min over a period of 60 minutes at 70° C. and pAg 8.15 while simultaneously adding Solutions F and G at the following accelerated flow rate sequence.

| | | | | | | | |
|---|---|---|---|---|---|---|---|
| Time (min) | 0 | 10 | 20 | 30 | 40 | 50 | 60 |
| Rate (ml/min) | 0 | 6.0 | 17.5 | 36.5 | 65 | 104.5 | 157.5 |

At the conclusion of the addition, the emulsion was cooled to 40° C. and combined with a phthalated gelatin solution (256 g gel/2.0 l DW). The emulsion was washed twice by the coagulation process of Yutzy and Russell U.S. Pat. No. 2,614,929. After completion of the washing procedure, the emulsion was combined with a bone gelatin solution (96 g gel/l DW) and adjusted to pH 6.2/pAg 8.22. The final emulsion had a median grain diameter of 0.36 μm with a coefficient of variation of 45%. The emulsion was reduction and gold fogged with a combination of thiourea dioxide (0.15 mg/mole Ag) and potassium tetrachloroaurate (20 mg/mole Ag).

The polydisperse emulsion was coated at a coverage of 3.50 g/m$^2$ on a film support, exposed for 15 seconds by a DuPont Cronex® screen, and processed in an X-Omat Processor® using seasoned Eastman Kodak RP X-Omat® developer. The direct positive image had a $D_{max}$ 2.68, $D_{min}$ 0.18, gamma 1.08, and a 3.0 log E exposure latitude.

EXAMPLE 8

This example illustrates the preparation of a polydisperse silver halide emulsion by introducing the host grain emulsion in successive steps rather than continuously.

A monodisperse silver bromide host grain emulsion (0.45–0.50 μm) was prepared by conventional double jet procedures, physically ripened, washed, and used in the following steps:

Step 1

A reaction vessel was charged with 30% of the total weight of the host grain emulsion and 1,10-dithia-4,7,13,16-tetraoxacyclooctadecane (0.085 g/mole Ag). The mixture was adjusted to pH 5.3 and pAg 9.2 at 71.1° C.

Step 2

An accelerated flow rate double jet addition of aqueous silver nitrate and sodium bromide solutions was carried out according to the following schedule

| | | | | |
|---|---|---|---|---|
| Time (min) | 0–3 | 3–20 | 20–21.5 | |
| Rate (ml/min) | 106 | 106–424 | 424–22.8 | moles of AgSoln. |

Step 3

After 5 minutes, an additional 30% of the total weight of the host grain emulsion at 43.3° C. was added to the reaction vessel while the accelerated flow rate was continued.

Step 4

After 10 minutes, the final 40% of the host grain emulsion at 43.3° C. was added to the emulsion.

Step 5

After 21.5 minutes, the polydisperse core emulsion (0.90–0.95 μm mean grain diameter) was adjusted to pH 5.50/pAg 8.3 at 71.1° C. and then sulfur plus gold sensitized.

Step 6

The core emulsion was adjusted to pAg 9.0 and shelled by the double jet addition of the aqueous silver nitrate and sodium bromide solutions at a constant flow-rate (424 ml/min/45.6 mole Ag solution) over a period of 26 minutes at 71.1° C. to obtain a polydisperse emulsion. The emulsion contained a population of three grain sizes, namely ~1.20 μm, ~1.38 μm and ~1.58 μm with a mean grain diameter of 1.32 μm.

After washing via diafiltration, the emulsion was sulfur sensitized, coated on a glass plate at 0.0557 g Ag/m$^2$ and 0.121 g gel/m$^2$, exposed to tungsten light and processed for 2 minutes/23.9° C. in a hydroquinone-Elon® (p-methylaminophenol hemisulfate) developer containing 2.1 g/l of 4-(β-methanesulfonamidoethyl)phenylhydrazine hydrochloride as a nucleating agent to obtain a reversal image. The sensitometric results are in Table I.

CONTROL B

A conventional monodisperse core-shell silver bromide emulsion (~1.38 μm mean grain diameter) was prepared as described in Evans U.S. Pat. No. 3,761,276. The core was sulfur plus gold sensitized and the shell was sulfur sensitized. The emulsion was coated, exposed and processed as described in Example 8 to obtain a reversal image. See Table I.

TABLE I

| | *Relative Speed | γ | D-max | D-min+ | Comments |
|---|---|---|---|---|---|
| Example 8 | 100 | 0.55 | 0.78 | .04 | polydisperse |
| Control B | 126 | 0.75 | 0.84 | .02 | monodisperse |

*Relative speed measured at $\frac{D_{max} - D_{min}^{+}}{2}$

+Density of support subtracted from measured minimum density to give the net minimum density.

Note the lower contrast obtained (greater exposure latitude) with no large loss in reversal speed (−0.10 log E) or maximum density (−0.06).

The invention has been described in detail with particular reference to preferred embodiments thereof, but it will be understood that variations and modifications can be effected within the spirit and scope of the invention.

What is claimed is:

1. In a process for the preparation of a photographic silver halide emulsion comprised of concurrently introducing silver and halide ions into a reaction vessel containing a dispersing medium to produce radiation sensitive silver halide grains, the improvement comprising producing a predetermined size distribution of the radiation sensitive silver halide grains, including selection of maximum and minimum grain diameters and selection of the distribution of grains of maximum, minimum, and intervening diameters, by the steps of introducing into the reaction vessel a silver halide emulsion consisting essentially of a dispersing medium and stable silver halide grains forming an initial population of host grains capable of acting as deposition sites for the silver and halide ions, introducing into the reaction vessel the silver and halide ions without producing additional stable silver halide grains, thereby depositing silver halide onto the host grains in the reaction vessel to increase their diameters, continuing and regulating introduction into the reaction vessel of the silver halide emulsion consisting essentially of the dispersing medium and the stable silver halide grains to provide additional host grains during the course of introducing the silver and halide ions and thereby obtaining the predetermined size distribution of the radiation-sensitive silver halide grains in the photographic emulsion, controlling the minimum diameter of the radiation sensitive silver halide grains in the emulsion by controlling the diameter of the silver halide host grains introduced, and terminating silver halide grain growth when deposition onto the initial population of host grains has produced radiation sensitive silver halide grains of the desired maximum diameter.

2. A process according to claim 1 in which the stable silver halide grains acting as host grains are monodisperse.

3. A process according to claim 1 in which sensitivity modifying ions are associated with the stable silver halide host grains.

4. A process according to claim 3 in which the stable silver halide host grains contain a Group VIII noble metal.

5. A process according to claim 3 in which the stable silver halide host grains contain iodide.

6. A process according to claim 1 in which the stable silver halide host grains are introduced into the reaction vessel at a substantially uniform rate while the silver and halide ions are being introduced into the reaction vessel.

7. A process according to claim 1 in which the stable silver halide host grain are introduced into the reaction vessel at an accelerated rate while at least a portion of the silver and halide ions are being introduced into the reaction vessel.

8. A process according to claim 1 in which the stable silver halide host grain are introduced into the reaction vessel at an decreasing rate while at least a portion of the silver and halide ions are being introduced into the reaction vessel.

9. A process according to claim 1 in which the stable host silver halide grains are introduced into the reaction vessel in a plurality of discrete steps.

10. A process according to claim 1 in which introduction of the silver and halide ions is undertaken at an accelerating rate.

11. A process according to claim 10 in which accelerated introduction of at least one of the silver and halide ions is achieved by increasing their solution concentration.

12. A process according to claim 1 in which the silver and halide ions are introduced into the reaction vessel in the form of silver halide grains capable of being ripened out during precipitation.

13. In a process for the preparation of a photographic silver halide emulsion comprised of concurrently introducing silver and halide ions into a reaction vessel containing a dispersing medium to produce radiation sensitive silver halide grains, the improvement comprising producing an emulsion exhibiting an extended exposure latitude comprised of a dispersing medium and silver halide grains differing in diameter wherein the maximum and minimum grain diameters present are controlled and the relative frequency of grain size occurrences over the 90 percent mid-range of grain diameters present differs by less than 20 percent, by the steps of introducing into the reaction vessel a monodisperse silver halide emulsion consisting essentially of a dispersing medium and stable silver halide grains forming an initial population of stable silver halide host grains capable of acting as deposition sites for the silver and halide ions, depositing onto the silver halide host grains additional silver halide precipitated by separately introducing into the reaction vessel an aqueous solution containing a soluble silver salt and an aqueous solution containing a soluble halide salt, thereby increasing the diameters of the host grains in the reaction vessel, continuing introduction into the reaction vessel of the silver halide emulsion consisting essentially of the dispersing medium and the stable silver halide grains at a rate which remains substantially invariant in relation to the rates of introduction of the silver and halide salts to thereby obtain a grain size distribution of relatively invariant grain size frequency in the radiation-sensitive silver halide emulsion being produced, and terminating silver halide grain growth when deposition onto the initial population of host grains has produced radiation sensitive silver halide grains capable of a photographic senstivity at least 2 log E greater than the initial population of host grains.

14. A process according to claim 13 wherein the host silver halide grains are silver bromide or silver bromoiodide grains having a mean diameter above about 0.02 μm.

15. A process according to claim 13 wherein the host silver halide grains have a mean diameter above about 0.1 μm.

16. In a process for the preparation of a photographic silver halide emulsion comprised of concurrently introducing silver and halide ions into a reaction vessel containing a dispersing medium to produce radiation sensitive silver halide grains, the improvement comprising shifting the mean diameter of the silver halide grains nearer the minimum diameter of the silver halide grains present and thereby increasing the maximum density producing capability of the silver halide emulsion, by the steps of introducing into the reaction vessel a monodisperse silver halide emulsion consisting essentially of a dispersing medium and stable silver halide grains forming an initial population of host grains capable of acting as deposition sites for the silver and halide ions, depositing onto the silver halide host grains additional silver halide precipitated by separately introducing into the reaction vessel an aqueous solution containing a soluble silver salt and an aqueous solution containing a soluble halide salt, thereby increasing the diameters of the host grains in the reaction vessel, accelerating introduction into the reaction vessel of the silver halide emulsion to provide an increasing proportion of stable host grains during the course of separately introducing the aqueous solutions and thereby obtaining a maximum relative frequency of grain sizes within the range of grain sizes extending from the minimum grain diameter of the emulsion to grain diameters 20 percent larger than the minimum grain diameter, and terminating silver halide grain growth when deposition onto the initial population of host grains has produced radiation sensitive silver halide grains of the desired maximum grain diameter.

17. A process according to claim 16 wherein the host silver halide grains are silver bromide or silver bromoiodide grains having a mean diameter above about 0.02 μm.

18. A process according to claim 16 wherein the host silver halide grains have a mean diameter above about 0.1 μm.

19. A process according to claim 16 wherein the maximum relative frequency of grains occurs within 10 percent of the minimum grain diameter of the emulsion.

20. In a process for the preparation of a photographic silver halide emulsion comprised of concurrently introducing silver and halide ions into a reaction vessel containing a dispersing medium to produce radiation sensitive silver halide grains, the improvement comprising shifting the mean diameter of the silver halide grains nearer the maximum diameter of the silver halide grains present and thereby increasing photographic speed without increasing the maximum grain diameters, by the steps of introducing into the reaction vessel a monodisperse silver halide emulsion consisting essentially of a dispersing medium and stable silver halide grains forming an initial population of host grains capable of acting as deposition sites for the silver and halide ions, depositing onto the silver halide host grains additional silver halide precipitated by separately introducing into the reaction vessel an aqueous solution containing a soluble silver salt and an aqueous solution containing a soluble halide salt, thereby increasing the diameters of the host grains in the reaction vessel, decreasing the rate of introduction into the reaction vessel of the silver halide emulsion consisting essentially of the dispersing medium and the stable silver halide grains during the course of separately introducing the aqueous solutions and thereby obtaining a maximum relative frequency of grain sizes within the range of grain sizes extending from the maximum grain diameter of the emulsion to grain diameters 5 percent less than the maximum grain diameter, and terminating silver halide grain growth when deposition onto the initial population of host grains has produced radiation sensitive silver halide grains of the desired maximum grain diameter.

21. A process according to claim 20 wherein the host silver halide grains are silver bromide or silver bromoiodide grains having a mean diameter above about 0.02 μm.

22. A process according to claim 20 wherein the host silver halide grains have a mean diameter above about 0.1 μm.

23. A process according to claim 20 wherein the maximum frequency of silver halide grains occurs within 2 percent of the maximum grain diameter of the emulsion.

24. A silver halide emulsion comprised of a dispersing medium and silver halide grains differing in diameter wherein the relative frequency of grain size occurrences over the 90 percent mid-range of grain diameters present differs by less than 20 percent.

25. A silver halide emulsion according to claim 24 wherein the relative frequency of grain size occurrences over the 90 percent mid-range of grain diameters present differs by less than 10 percent.

26. A silver halide emulsion according to claim 25 wherein the relative frequency of grain size occurrences over the 90 percent mid-range of grain diameters present differs by less than 5 percent.

27. A silver halide emulsion according to claim 24 which ex.hibits an exposure latitude of at least 2 log E.

28. A silver halide emulsion according to claim 24 in which the silver halide grains trap photolytically generated electrons predominantly internally.

29. A silver halide emulsion according to claim 28 in which the silver halide emulsion is capable of producing direct positive images.

30. A silver halide emulsion according to claim 29 in which the silver halide grains capable of trapping photolytically genrated electrons predominantly internally are surfaced fogged.

31. A silver halide emulsion comprised of a dispersing medium and silver halide grains differing in diameter wherein the maximum relative frequency of grain sizes occurs within the range of grain sizes extending from the minimum grain diameter of the emulsion to grain diameters 20 percent larger than the minimum grain diameter.

32. A silver halide emulsion according to claim 31 wherein the maximum relative frequency of grain sizes occurs within the range of grain sizes extending from the minimum grain diameter of the emulsion to grain diameters 10 percent larger than the minimum grain diameter.

33. A silver halide emulsion comprised of a dispersing medium and silver halide grains differing in diameter wherein the maximum relative frequency of grain sizes occurs within the range of grain sizes extending from the maximum grain diameter of the emulsion to grain diameters 5 percent less than the maximum grain diameter.

34. A silver halide emulsion according to claim 33 wherein the maximum relative frequency of grain sizes occurs within the range of grain sizes extending from the maximum grain diameter of the emulsion to grain diameters 2 percent less than the maximum grain diameter.

35. A silver halide emulsion comprised of a dispersing medium and silver halide grains differing in diameter wherein a first maximum relative frequency of grain sizes occurs within the range of grain sizes extending the minimum grain diameter of the emulsion to grain diameters 20 percent larger than the minimum grain diameter and a second maximum relative frequency of grain sizes occurs within the range of grain sizes extending from the maximum grain diameter of the emulsion to grain diameters 5 percent less than the maximum grain diameter.

* * * * *